US010362862B2

(12) United States Patent
Symalla

(10) Patent No.: US 10,362,862 B2
(45) Date of Patent: Jul. 30, 2019

(54) RAILING SUPPORTED BUFFET

(71) Applicant: Daniel Symalla, Orangevale, CA (US)

(72) Inventor: Daniel Symalla, Orangevale, CA (US)

( * ) Notice: Subject to any disclaimer, the term of this patent is extended or adjusted under 35 U.S.C. 154(b) by 0 days.

(21) Appl. No.: 15/838,602

(22) Filed: Dec. 12, 2017

(65) Prior Publication Data

US 2018/0160800 A1 Jun. 14, 2018

Related U.S. Application Data

(60) Provisional application No. 62/432,781, filed on Dec. 12, 2016.

(51) Int. Cl.

| | |
|---|---|
| ***A47B 13/08*** | (2006.01) |
| ***A47B 23/04*** | (2006.01) |
| ***A47B 13/00*** | (2006.01) |
| ***A47B 5/02*** | (2006.01) |

(52) U.S. Cl.

CPC ..... *A47B 13/081* (2013.01); *A47B 5/02* (2013.01); *A47B 13/003* (2013.01); *A47B 23/04* (2013.01); *A47B 2200/0019* (2013.01); *A47B 2220/0008* (2013.01)

(58) Field of Classification Search

CPC .... A47B 5/02; A47B 5/06; A47B 5/04; A47B 5/00; A47B 23/04; D06F 81/06

USPC ..... 108/42, 47, 152

See application file for complete search history.

(56) References Cited

U.S. PATENT DOCUMENTS

| | | | | | |
|---|---|---|---|---|---|
| 1,392,257 | A | | 11/1888 | Cameron | |
| 1,571,753 | A | * | 2/1926 | Christian | A47B 31/06 108/47 |
| 2,267,861 | A | * | 12/1941 | Haley | A47C 7/70 108/135 |
| 2,867,401 | A | * | 1/1959 | Sheahan | A47C 7/68 108/47 |
| 3,146,986 | A | | 9/1964 | Gorth, Sr. | |
| 3,433,443 | A | | 3/1969 | Mangan | |
| 4,357,881 | A | * | 11/1982 | De Long | A47B 23/02 108/135 |
| 4,494,465 | A | | 1/1985 | Fick, Jr. | |
| 4,986,505 | A | | 1/1991 | Zabawski | |
| 5,009,380 | A | | 4/1991 | Fee | |
| 5,033,448 | A | * | 7/1991 | Sandweg | A47J 37/0786 126/25 R |
| 5,158,023 | A | * | 10/1992 | Allen | E04G 5/00 108/42 |

(Continued)

*Primary Examiner* — Jose V Chen

(74) *Attorney, Agent, or Firm* — Matthew M. Googe; Robinson IP Law, PLLC

(57) ABSTRACT

A rail-mounted buffet mountable to a railing having a top rail and one or more vertical balusters includes: a main bar buffet section having a flat surface area for supporting items on the main bar buffet section; a U-shaped channel located on an underside of the main bar buffet, the U-shaped channel having a back-side member and a front side member, wherein the back-side member and front side member are movable in relation to one another such that a width of the U-shaped channel is adjustable; a trust support having a first end and a second end, the trust support attached to the underside of the main bar buffet at the first end of the trust support; and a baluster support shaped to engage one of the one or more vertical balusters, the baluster support attached to the second end of the trust support.

10 Claims, 6 Drawing Sheets

(56) References Cited

U.S. PATENT DOCUMENTS 5,240,214 A 8/1993 Birnbaum
5,706,593 A * 1/1998 Allard ..... D06F 81/06 108/47
5,884,568 A 3/1999 Dombroski
5,984,249 A * 11/1999 Cohen ..... A47G 7/044 108/47
5,996,507 A * 12/1999 Joseph ..... B60N 3/001 108/125
6,082,270 A 7/2000 Zerger
6,224,029 B1 5/2001 Marble
6,474,244 B1 * 11/2002 Karpinski ..... E04H 4/14 108/42
7,121,213 B2 * 10/2006 Viazanko ..... A47B 5/02 108/42
7,210,414 B1 5/2007 Barone
7,444,773 B2 * 11/2008 Kolodziejczak, Sr. ..... G09F 21/04 108/44
8,479,664 B2 7/2013 Nelson
8,561,550 B2 10/2013 Raml
8,857,347 B1 * 10/2014 Liu ..... A47B 5/02 108/47
9,179,794 B2 11/2015 Darby
2006/0137578 A1 * 6/2006 Noding ..... A47B 5/02 108/152
2007/0101908 A1 * 5/2007 Makita ..... A47B 5/02 108/47
2008/0134430 A1 * 6/2008 Kirmon ..... A01K 1/035 5/10.1
2008/0282620 A1 11/2008 Deloney
2009/0020047 A1 1/2009 Noble
2009/0064905 A1 3/2009 Juda
2010/0101459 A1 * 4/2010 Nelson ..... A47B 5/04 108/47
2015/0135998 A1 * 5/2015 Barsch ..... G06F 1/1607 108/42
2015/0164224 A1 6/2015 Kemp
2015/0238012 A1 * 8/2015 Reviel ..... F16M 13/022 108/42
2016/0113390 A1 4/2016 Dias
2016/0353877 A1 * 12/2016 Brus ..... A47B 5/02

* cited by examiner

RAILING SUPPORTED BUFFET

CROSS-REFERENCE TO RELATED APPLICATION(S)

This application claims priority to U.S. Provisional Patent Application Ser. No. 62/432,781 for a Railing Supported Buffet to Daniel Symalla and filed on Dec. 12, 2016, the contents of which are incorporated herein by reference in its entirety.

FIELD

This disclosure relates to the field of tables or buffets. More particularly, this disclosure relates to a railing supported buffet for installation on an existing railing.

BACKGROUND

Patios and outdoor decks are popular locations for hosting and entertaining guests. A typical patio or outdoor deck includes a railing that surrounds an edge of the deck. A patio will typically feature patio furniture, such as a table and chairs, to allow guests on the patio to place food and drinks. However, patio furniture typically occupies a large area of the outdoor deck, and the deck may become crowded when a large number of guests are present.

While various attempts have been made to provide surfaces for food and drink around railings of a patio, such attempts typically require permanent or semi-permanent fixation of the surfaces to the patio railings. Attempted solutions are also often unstable, and may move when food or beverages are placed on the surfaces.

What is needed, therefore, is a railing supported buffet that is readily installed on an existing railing of a patio while providing a stable surface for the placement of food, beverages, and other items.

SUMMARY

The above and other needs are met by a rail supported buffet. In a first aspect, a rail-mounted buffet mountable to a railing having a top rail and one or more vertical balusters includes: a main bar buffet section having a flat surface area for supporting items on the main bar buffet section; a U-shaped channel located on an underside of the main bar buffet, the U-shaped channel having a back-side member and a front side member, wherein the back-side member and front side member are movable in relation to one another such that a width of the U-shaped channel is adjustable; a trust support having a first end and a second end, the trust support attached to the underside of the main bar buffet at the first end of the trust support; and a baluster support shaped to engage one of the one or more vertical balusters, the baluster support attached to the second end of the trust support.

In one embodiment, the trust support is formed of a first section that is telescopically engaged with a second section such that a length of the trust support is adjustable.

In another embodiment, the trust support is pivotally attached to the main bar buffet at the first end. The trust support is pivotally attached to the baluster support at the second end of the trust support.

In yet another embodiment, the baluster support further includes a clamshell formed of a first clam shell portion hingedly engaged with a second clam shell such that the baluster support fits around one of the one or more balusters.

In one embodiment, the baluster support further includes a resilient foam material located between the clamshell of the baluster support and the baluster.

In another embodiment, the rail-mounted buffet further includes one or more straps associated with the U-shaped channel for extending across the U-shape channel to secure the U-shaped channel around the top rail.

In a second aspect, a rail-mounted buffet mountable to a railing having a top rail and one or more vertical balusters includes: a main bar buffet section having a flat surface area for supporting items on the main bar buffet section; a U-shaped channel located on an underside of the main bar buffet, the U-shaped channel having a back-side member and a front side member, wherein the back-side member and front side member are movable in relation to one another such that a width of the U-shaped channel is adjustable; a trust support having a first end and a second end, the trust support attached to the underside of the main bar buffet at the first end of the trust support; and a baluster support comprising a clamshell formed of a first clam shell portion engaged with a second clam shell such that the baluster support fits around one of the one or more balusters, the baluster support attached to the second end of the trust support.

In one embodiment, the trust support is formed of a first section that is telescopically engaged with a second section such that a length of the trust support is adjustable.

In another embodiment, the baluster support further includes a resilient foam material located between the clamshell of the baluster support and the baluster.

In a third aspect, a rail-mounted buffet mountable to a railing having a top rail and one or more vertical balusters includes: a main bar buffet section having a flat surface area for supporting items on the main bar buffet section; a U-shaped channel located on an underside of the main bar buffet, the U-shaped channel having a back-side member and a front side member, wherein the back-side member and front side member are movable in relation to one another such that a width of the U-shaped channel is adjustable; a trust support extending having a first end and a second end, the trust support formed of a first section that is telescopically engaged with a second section such that a length of the trust support is adjustable, the trust support attached to the underside of the main bar buffet at the first end of the trust support; and a baluster support comprising a clamshell formed of a first clam shell portion engaged with a second clam shell such that the baluster support fits around one of the one or more balusters, the baluster support attached to the second end of the trust support.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

A railing supported buffet or bar surface is provided that mounts to a railing and balusters of a patio or deck area. A typical railing includes a top rail positioned atop a plurality of balusters that extend from the top rail to a lower end adjacent a patio or deck surface. The railing supported buffet of the present disclosure is configured to mount on both the top rail and one or more of the balusters to support the railing supported buffet on top of the railing.

Figure 1:
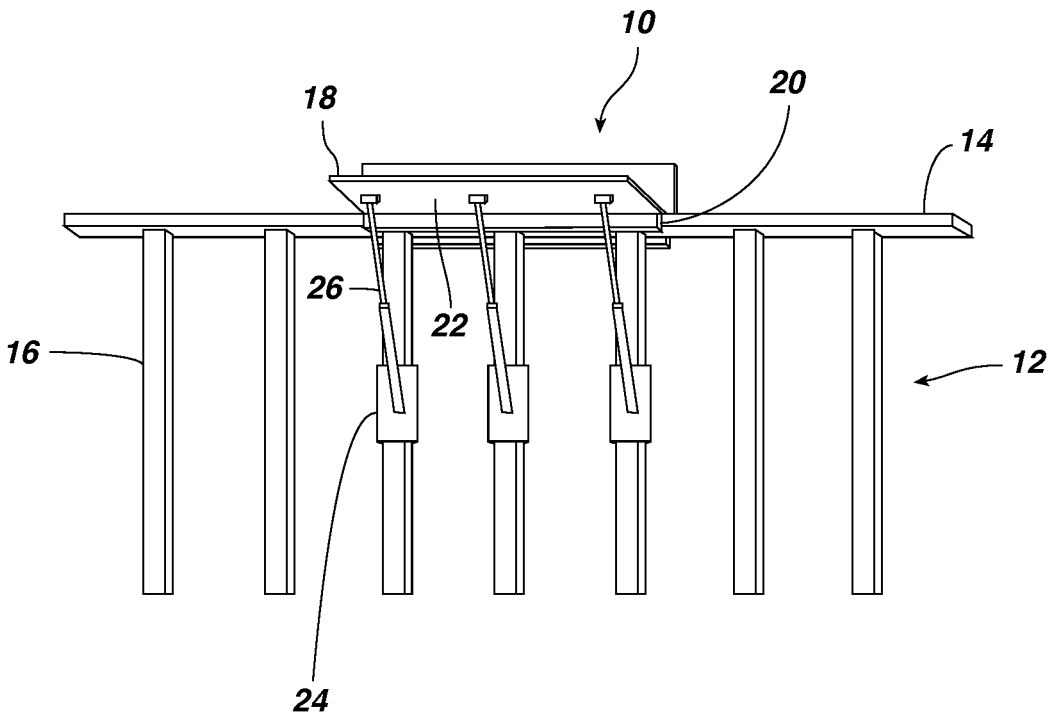
FIG. 1 shows a railing supported buffet according to one embodiment of the present disclosure.

FIG. 1 shows a basic embodiment of a railing supported buffet 10 mounted on a railing 12. The railing 12 includes an elongate horizontal top rail 14 and one or more balusters 16 oriented perpendicular to and extending downward from the top rail 14. The railing supported buffet 10 is configured to engage the railing 12 such that items may be securely placed on the buffet 10. Further, the buffet 10 is adjustable such that the buffet may be securely mounted on railings having various dimensions, including varying dimensions of the top rail 14 and vertical balusters 16.

Figure 2:
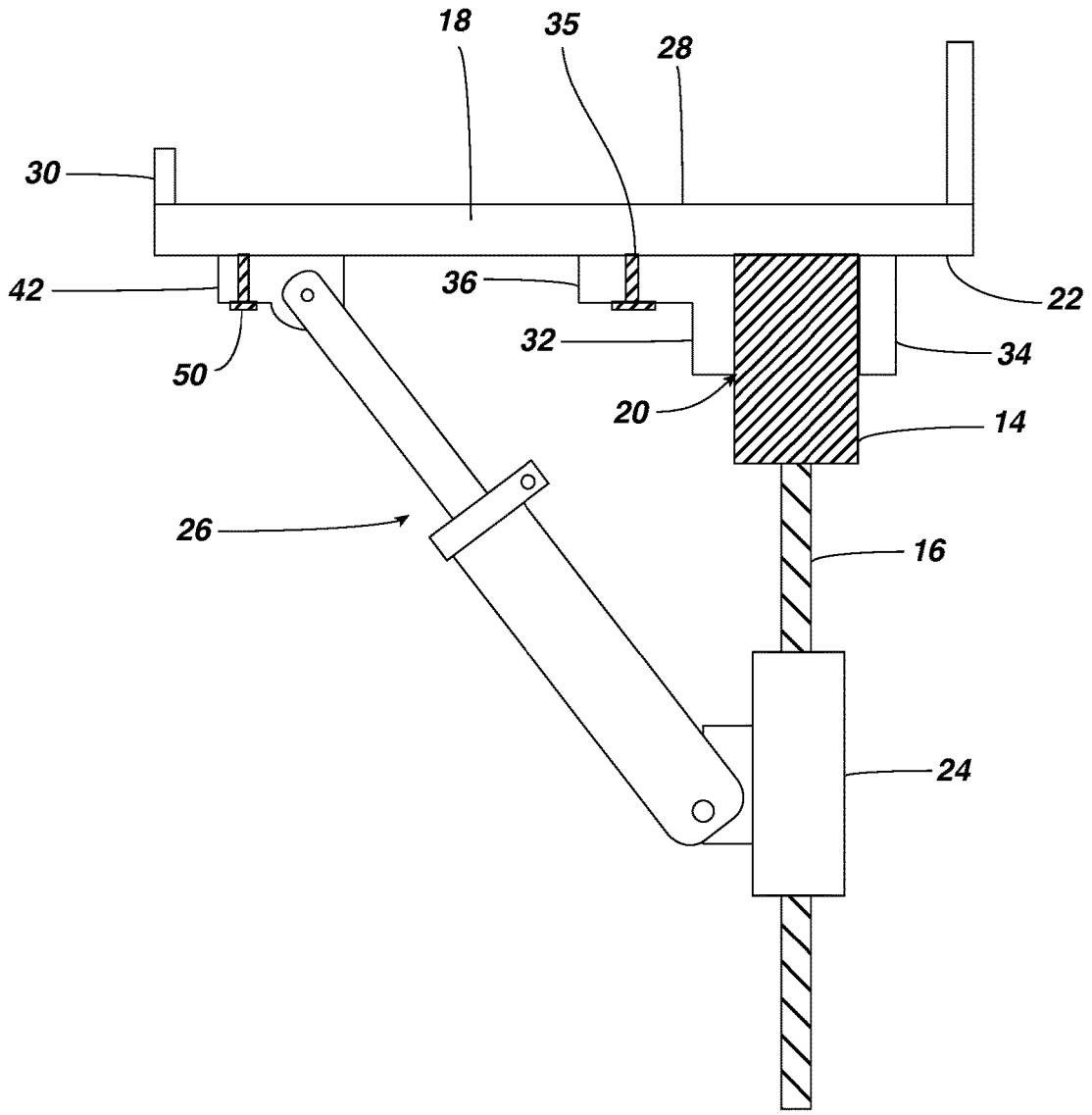
FIG. 2 is a side view of a railing supported buffet attached to a railing according to one embodiment of the present disclosure.

The railing supported buffet includes a main bar buffet section 18, an adjustable U-channel 20 mounted on an underside 22 of the main bar buffet section 18, a clam shell baluster support 24 clamped around one or more of the balusters 16 of the railing 12, and a telescoping support truss 26 attached between the main bar buffet section 18 and the clam shell baluster support 24. As shown in FIG. 2, the main bar buffet section 18 is supported along the horizontal top rail 14 such that the U-shaped channel 20 engages the top rail 14. The telescoping support truss 26 extends from the underside 22 of the main bar buffet section 18 to the balusters 16 to further support the main bar buffet section 18 on the top rail 14.

Figure 3:
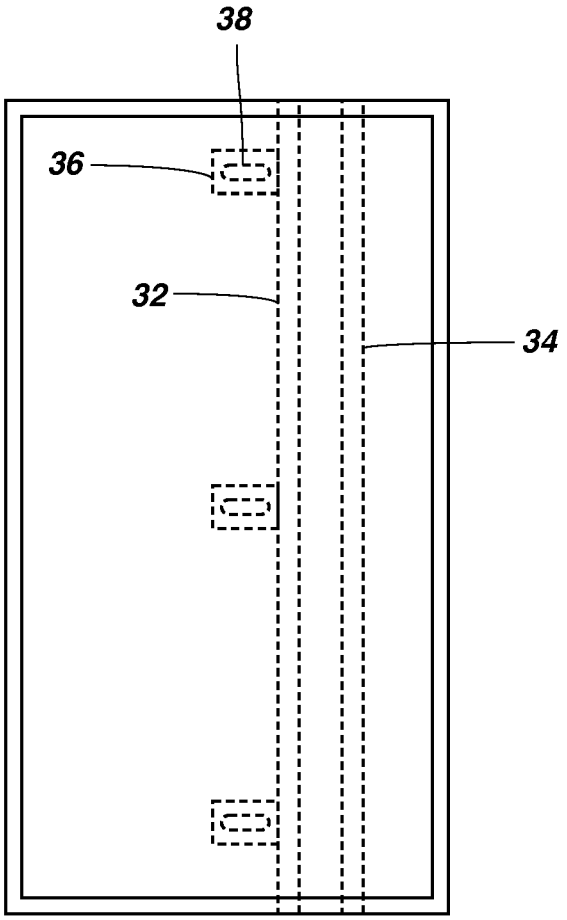
FIG. 3 is a top view of a main buffet bar of a railing supported buffet according to one embodiment of the present disclosure.
Figure 4:
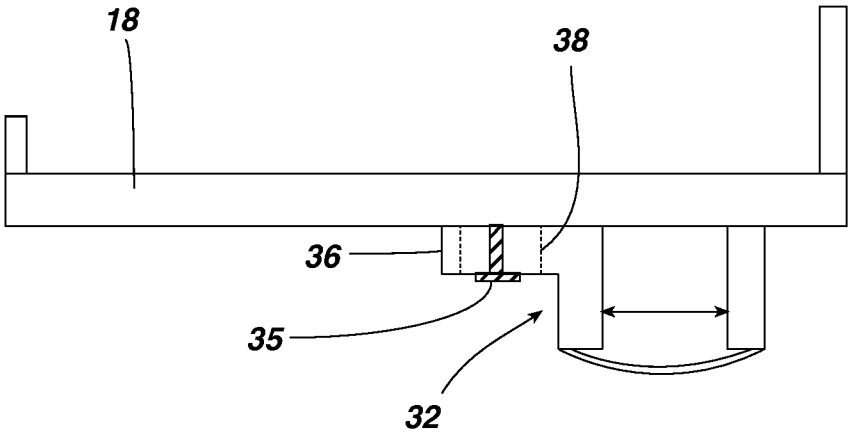
FIG. 4 is a side view of a main buffet bar of a railing supported buffet according to one embodiment of the present disclosure.

Referring to FIGS. 3 and 4, the main bar buffet section 18 includes a flat and preferably rectangular surface area on an upper surface 28 for receiving food or beverages on the surface area. The main bar buffet section 18 may include a surrounding lip 30 to prevent items placed on the main bar buffet section 18 from rolling or falling off of the surface of the main bar buffet 18. The lip 30 is preferably taller along a back edge of the main bar buffet section 18 than along a front edge of the main bar buffet section 18. The main bar buffet section 18 may be formed of a variety of suitable materials, such as wood, plastic, or metal. Further, while the figures illustrate the surface of the main bar buffet section 18 being formed as a rectangle, the main bar buffet section 18 may be formed into a variety of other suitable shapes, such as a rounded shape.

As shown in FIG. 4, the adjustable U-channel 20 is mounted to the underside 22 of the main bar buffet section 18 for engaging the top rail 14 of the railing 12. The adjustable U-channel 20 includes elongate a front side 32 and opposing back side 34 that extend across a width of the underside 22 of the main bar buffet section 18. The back side 34 is preferably fixed to the underside 22 of the main bar buffet section 18 using one or more fasteners such as screws or bolts. The back side 34 is fixed to the underside of the main bar buffet such that the back side is substantially perpendicular to the underside 22 of the main bar buffet section 18. The front side 30 is preferably slidably mounted to the underside 22 of the main bar buffet section 18 such that the front side 32 may be adjusted with respect to the back side 34. The front side 32 is mounted, for example, with one or more bolts 35 extending through one or more tabs 36 attached to the front side 32. The tabs 36 include an elongate aperture 38 through which the bolt extends. When the bolts 35 are loosened, the front side 32 may be adjusted such that the top rail 14 of the railing 12 is clamped between the front side 32 and back side 34 of the adjustable U-channel 20. When the bolts 35 are tightened, a position of the front side 32 becomes fixed in relation to the back side 34.

With further reference to FIG. 3, the adjustable U-shaped channel 20 includes one or more adjustable length clamps or straps 40 extending from front side 32 to the back side 34 of the U-shaped channel 34. The clamps or straps 40 are secured at first ends to one side of the U-shaped channel 20 and at second ends to an opposing side of the U-shaped channel 20. When the main bar buffet section 18 is mounted to the top rail 14 of the railing 12, the clamps or straps 40 are positioned under the top rail 14 to further secure the main bar buffet section 18 to the top rail 14 of the railing 12.

Figure 5A:
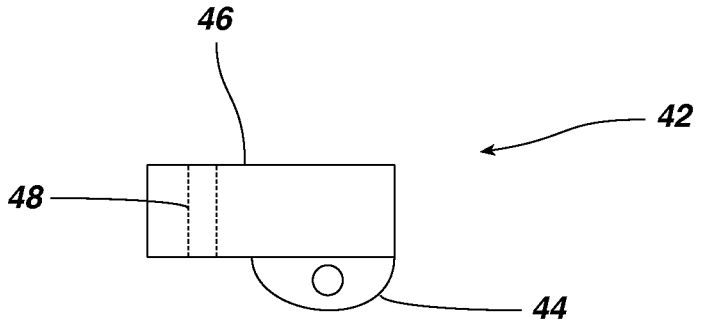
FIGS. 5A and 5B show a truss attachment according to one embodiment of the present disclosure.
Figure 5B:
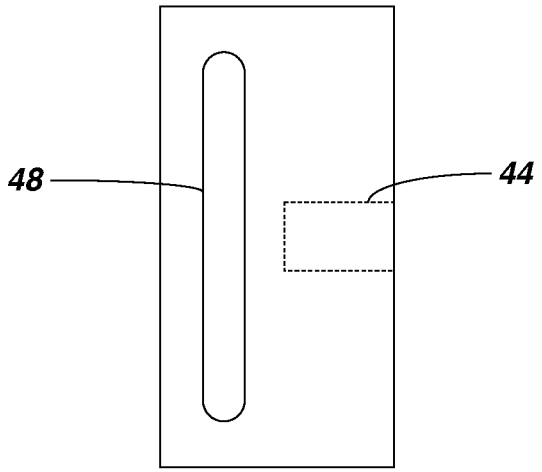

Referring now to FIGS. 5A and 5B, one or more truss attachments 42 are also mounted on the underside 22 of the main bar buffet section 18. The truss attachments 42 are attached across a width of the main bar buffet section 18 and are shaped to pivotally engage the telescoping support trusses 26 as described in greater detail below. The truss attachments 42 include a downward-extending tab 44 for attaching to the support trusses 26 and a plate 46 for mounting the truss attachments 42 to the main bar buffet section 18. The plate 46 includes a horizontal slot 48 for receiving a bolt 50 that attaches the truss attachment to the main bar buffet section 18. The truss attachment 42 may be adjusted along a width of the horizontal slot 48 such that the truss attachment 42 is aligned with the support trusses 26 and balusters 16 as described below. As shown in FIG. 2, the truss attachments 42 are secured to the underside 22 of the main bar buffet section 18 at the plate 46 and to the support trusses 26 at the downward-extending tab 44.

Figure 6A:
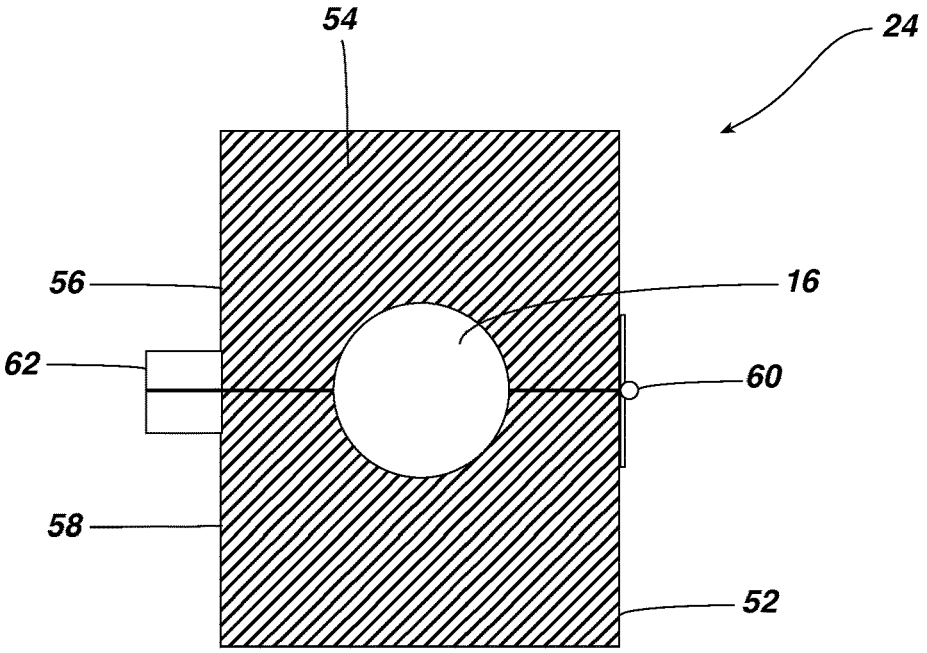
FIGS. 6A and 6B show a clam shell baluster support according to one embodiment of the present disclosure.
Figure 6B:
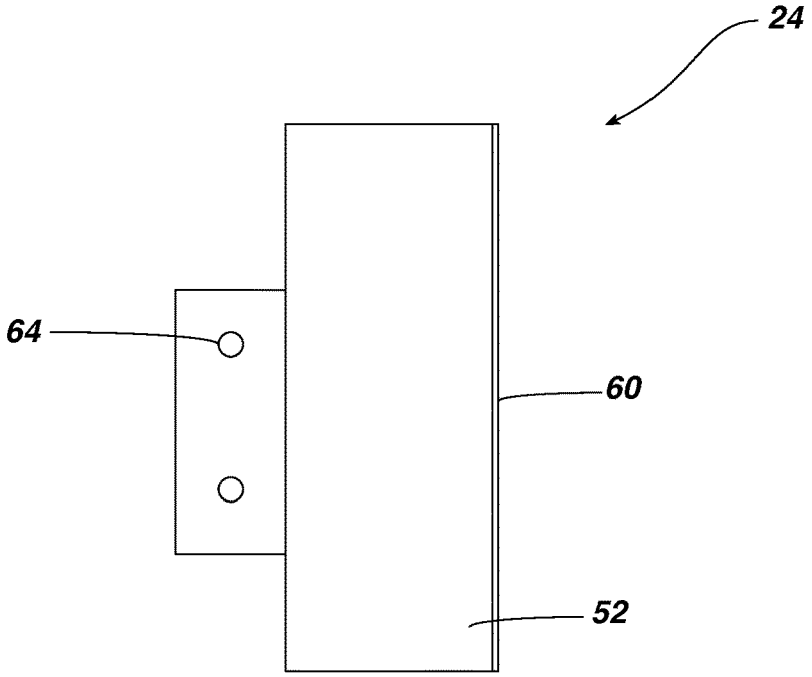

FIGS. 6A and 6B show the clam shell baluster support 24 that includes a hinged shell 52 formed around a foam 54 or other padded or resilient material within the hinged shell 52. The shell 52 may be formed having either a rectangular or circular cross-sectional area and includes a hollow interior. The shell 52 is preferably formed of a first clam shell portion 56 that is attached to a second clam shell portion 58 along a hinge 60. The foam or padded material 54 are placed within a hollow interior of the shell 52 such that when the shell 52 is closed around the baluster 16, the foam or padded material 54 deforms around the baluster 16. The shell 52 includes tabs 62 formed the first clam shell portion 56 and second clam shell portion 58 on an opposite side of the clam shell baluster support 24 from the hinge 60. The tabs 62 include one or more holes 64 formed therethrough. A bolt or other fastener is placed through the holes 64 to hold the clam shell baluster support 24 in a closed position. One of the holes 64 may further engage an end of one of the support trusses 26 as discussed below.

Figure 7:
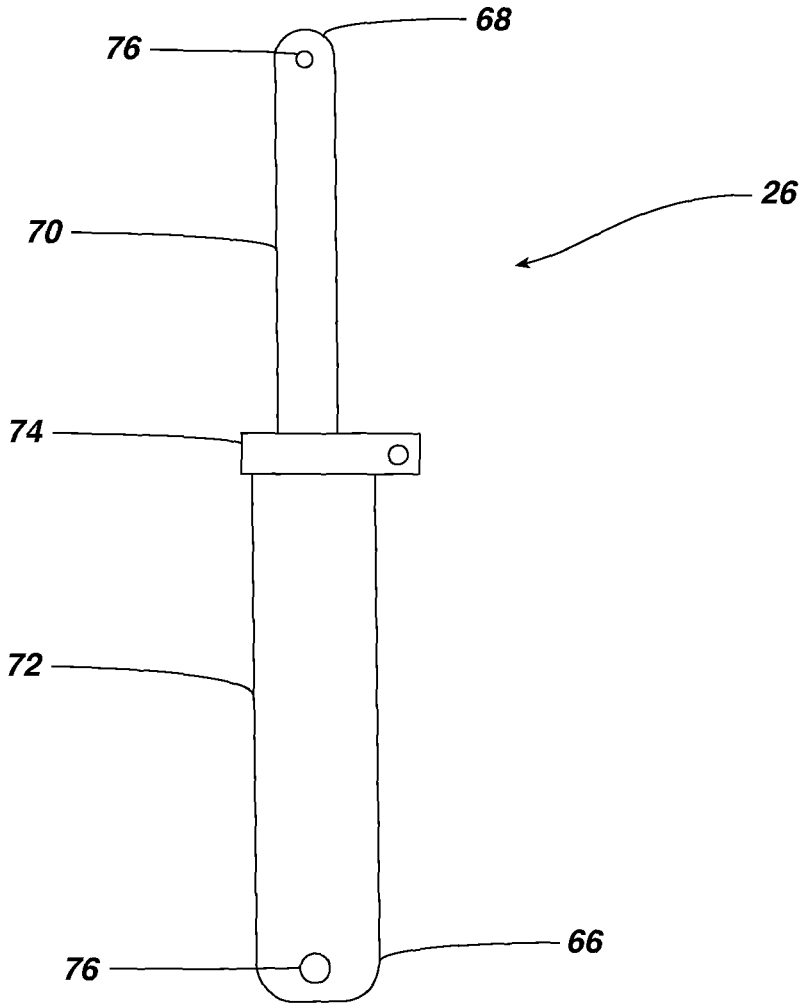
FIG. 7 shows a telescoping support truss according to one embodiment of the present disclosure.

The telescoping support truss 26 (FIG. 7) is attached at a first end 66 to one of the holes 64 of the clam shell baluster support and at a second end 68 to the truss attachment 42 of the main buffet section 18. The telescoping support truss 26 includes a shaft 70 that is inserted into a sleeve 72. The shaft 70 is maintained at least partially within the sleeve 72 with a clamp 74. Bores 76 formed on ends of the telescoping support truss 42 for attaching the telescoping support truss 26 to the truss attachment 42 of the main buffet bar 18 and the clam shell baluster support 24.

In operation, a user installs the railing supported buffet 10 on the railing 12 of a porch or deck area. The user may first attach one or more clam shell baluster supports 24 to balusters of the porch railing by closing the clam shell baluster support 24 around the baluster 16. The foam or padded material 54 on an inside of the clam shell baluster support 24 contacts the baluster 16 to form a tight fit with the baluster 16 while preventing damage to the baluster 16. After closing the clam shell baluster support 24 around the baluster 16, one or more telescoping support trusses 26 may be attached to the clam shell baluster supports 24.

The adjustable U-channel 20 of the main buffet section 18 is opened and the main buffet section 18 placed on top of the top rail 14 of the railing 12. After placing the U-channel 20 over the top rail 14, the adjustable U-channel 20 may be tightened such that the front side 32 and back side 34 contact the top rail 14 of the railing 12. Bolts mounting the front side 32 to the main buffet bar section 18 are tightened to secure the adjustable U-channel 20 to the top rail 14. The telescoping support trusses 26 are finally attached at one end to the clam shell baluster supports 24. Lengths of the telescoping support trusses 26 are adjusted such that the main buffet bar section 18 is level, and the clamps 74 of the telescoping support trusses 26 are tightened to fix a length of the telescoping support trusses 26.

The railing supported buffet 10 of the present disclosure advantageously allows a user to add additional areas for supporting food and beverages around a railing of a porch or patio area. The railing supported buffet 10 is readily attached to railings having various shapes and dimensions without causing damage to the railing. Further, because the railing supported buffet is supported by both the top rail and one or more balusters of the railing, the railing supported buffet is stably mounted to the railing.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A rail-mounted buffet mountable to a railing having a top rail and one or more vertical balusters, the rail-mounted buffet comprising:

a main bar buffet section having a flat surface area for supporting items on the main bar buffet section;

a U-shaped channel located on an underside of the main bar buffet formed between a back-side member and a front side member, wherein the back-side member and front side member are movable in relation to one another such that a width of the U-shaped channel is adjustable, and wherein a position of the front side member relative to the backside member may be fixed in varying locations such that a width of the U-shaped channel is adjustably fixed;

a trust support having a first end and a second end, the trust support attached to the underside of the main bar buffet at the first end of the trust support;

a baluster support comprising a clamshell formed of a first clam shell portion engaged with a second clam shell such that the baluster support fits around one of the one or more balusters, the baluster support attached to the second end of the trust support.

2. The rail mounted buffet of claim 1, wherein the trust support is formed of a first section that is telescopically engaged with a second section and wherein a length of the trust support is adjustable.

3. The rail mounted buffet of claim 1, wherein the trust support is pivotally attached to the main bar buffet at the first end, and wherein the trust support is pivotally attached to the baluster support at the second end of the trust support.

4. The rail mounted buffet of claim 1, the baluster support further comprising a resilient foam material located around an interior of the clamshell of the baluster support such that the resilient foam material surrounds the baluster.

5. The rail mounted buffet of claim 1, further comprising one or more straps associated with the U-shaped channel for extending across the U-shape channel to secure the U-shaped channel around the top rail.

6. The rail-mounted buffet of claim 1, wherein the trust support is formed of a first section that is telescopically engaged with a second section.

7. The rail-mounted buffet of claim 6, the baluster support further comprising a resilient foam material located around an interior of the clamshell of the baluster support such that the resilient foam material surrounds the baluster.

8. A rail-mounted buffet mountable to a railing having a top rail and one or more vertical balusters, the rail-mounted buffet comprising:

a main bar buffet section having a flat surface area for supporting items on the main bar buffet section;

a U-shaped channel located on an underside of the main bar buffet formed between a back-side member and a front side member, wherein the back-side member and front side member are movable in relation to one another such that a width of the U-shaped channel is adjustable, and wherein a position of the front side member relative to the backside member may be fixed in varying locations such that a width of the U-shaped channel is adjustably fixed;

a trust support extending having a first end and a second end, the trust support formed of a first section that is telescopically engaged with a second section such that a length of the trust support is adjustable, the trust support attached to the underside of the main bar buffet at the first end of the trust support;

a baluster support comprising a clamshell formed of a first clam shell portion engaged with a second clam shell such that the baluster support fits around one of the one or more balusters, the baluster support attached to the second end of the trust support.

9. The rail-mounted buffet of claim 1, wherein the back-side member and front-side member are slidably adjustable relative to one another for varying a width of the U-shaped channel.

10. The rail-mounted buffet of claim 9, further comprising one or more fasteners inserted through one of the back-side member and front-side member for securing a location of the back-side member relative to the front-side member.

* * * * *